US007666122B2

(12) United States Patent
Chiles et al.

(10) Patent No.: US 7,666,122 B2
(45) Date of Patent: Feb. 23, 2010

(54) ELLIPTICAL EXERCISE MACHINE

(75) Inventors: Mark William Chiles, Yorba Linda, CA (US); Felipe J. Marin, Santa Ana, CA (US); James Dey, Corona, CA (US); Victor Torres Cornejo, Tustin, CA (US); Kevin Patrick Corbalis, Tustin, CA (US)

(73) Assignee: Unisen, Inc., Irvine, CA (US)

( * ) Notice: Subject to any disclaimer, the term of this patent is extended or adjusted under 35 U.S.C. 154(b) by 475 days.

(21) Appl. No.: 11/458,338

(22) Filed: Jul. 18, 2006

(65) Prior Publication Data

US 2007/0161464 A1 Jul. 12, 2007

Related U.S. Application Data

(60) Provisional application No. 60/700,245, filed on Jul. 18, 2005.

(51) Int. Cl.
*A63B 22/06* (2006.01)
*A63B 22/02* (2006.01)

(52) U.S. Cl. ..... 482/52; 482/51; 482/57

(58) Field of Classification Search ..... 482/51–57, 482/70, 79–80
See application file for complete search history.

(56) References Cited

U.S. PATENT DOCUMENTS 5,374,227 A 12/1994 Webb
5,637,058 A * 6/1997 Rodgers, Jr. ..... 482/51
5,690,589 A 11/1997 Rodgers, Jr.
5,738,614 A 4/1998 Rodgers, Jr.
5,769,760 A 6/1998 Lin et al.
5,788,610 A 8/1998 Eschenbach
5,848,954 A 12/1998 Stearns et al.
5,899,833 A 5/1999 Ryan et al.
5,913,751 A 6/1999 Eschenbach
5,924,962 A 7/1999 Rodgers, Jr.
5,997,445 A 12/1999 Maresh et al.
6,063,008 A 5/2000 McBride et al.
6,196,948 B1 3/2001 Stearns et al.
6,206,804 B1 3/2001 Maresh
6,277,055 B1 8/2001 Birrell et al.
6,500,096 B1 12/2002 Farney
6,544,146 B1 4/2003 Stearns et al.
6,645,125 B1 11/2003 Stearns et al.
6,672,994 B1 1/2004 Stearns et al.
6,837,829 B2 1/2005 Eschenbach
7,223,209 B2 * 5/2007 Lee ..... 482/52
7,238,146 B1 * 7/2007 Chen ..... 482/52
2001/0056010 A1 12/2001 Stearns et al.
2004/0053748 A1 * 3/2004 Lo et al. ..... 482/52
2004/0097339 A1 5/2004 Moon
2004/0235621 A1 11/2004 Eschenbach
2004/0248704 A1 12/2004 Rodgers, Jr.
2004/0248705 A1 12/2004 Rodgers, Jr.
2004/0248706 A1 12/2004 Rodgers, Jr.

(Continued)

*Primary Examiner*—Steve R Crow
(74) *Attorney, Agent, or Firm*—Knobbe, Martens, Olson & Bear, LLP

(57) ABSTRACT

An elliptical exercise machine features a pair of translating members to which a pair of foot members is axially secured. The foot members each pivots with respect to the associated translating member. The generated motion allows a user to lock a knee before beginning downward movement and allows a user to bend the same knee before beginning forward movement such that the motion is more natural for the user.

15 Claims, 3 Drawing Sheets

U.S. PATENT DOCUMENTS

2004/0248707 A1 12/2004 Rodgers, Jr.
2004/0248708 A1 12/2004 Rodgers, Jr.
2004/0248709 A1 12/2004 Rodgers, Jr.
2004/0248710 A1 12/2004 Rodgers, Jr.
2004/0248711 A1 12/2004 Rodgers, Jr.
2005/0003932 A1 1/2005 Chen et al.
2006/0166791 A1 * 7/2006 Liao et al. ..... 482/52

* cited by examiner

ELLIPTICAL EXERCISE MACHINE

RELATED APPLICATIONS

The present application claims the priority benefit of U.S. Provisional Patent Application No. 60/700245, which was filed on Jul. 18, 2005 and which is hereby incorporated by reference in its entirety.

BACKGROUND OF THE INVENTION

1. Field of the Invention

The present invention generally relates to exercise machines. More particularly, the present invention relates to exercise machines that are configured to generate elliptical foot motions.

2. Description of the Related Art

Cardiovascular exercise is a popular form of exercise in most fitness facilities. To provide a suitable cardiovascular workout, a user often exercises for extended periods of time. As such, exercise machines that allow an extended cardiovascular workout while cushioning knee joints and ankle joints from pounding are desired. Moreover, exercise machines that allow users to simulate normal body movements without undue stress being placed upon the user's body parts are desired.

SUMMARY OF THE INVENTION

In view of the desire to provide exercise equipment that cushions the movement of user's body parts, an elliptical exercise machine has been created that allows a user to more closely simulate normal walking and running movement without the attendant pounding that results from running on treadmills or road surfaces. In particular, the elliptical exercise machine is designed to allow knee joints to be locked before the leg begins a generally downward motion, which is similar to that experienced during running and walking under normal conditions.

BRIEF DESCRIPTION OF THE DRAWINGS

These and other features, aspects and advantages of the present invention will be described with reference to the following figures, which figures comprise five pictures.

DETAILED DESCRIPTION OF THE PREFERRED EMBODIMENT

Figure 1:
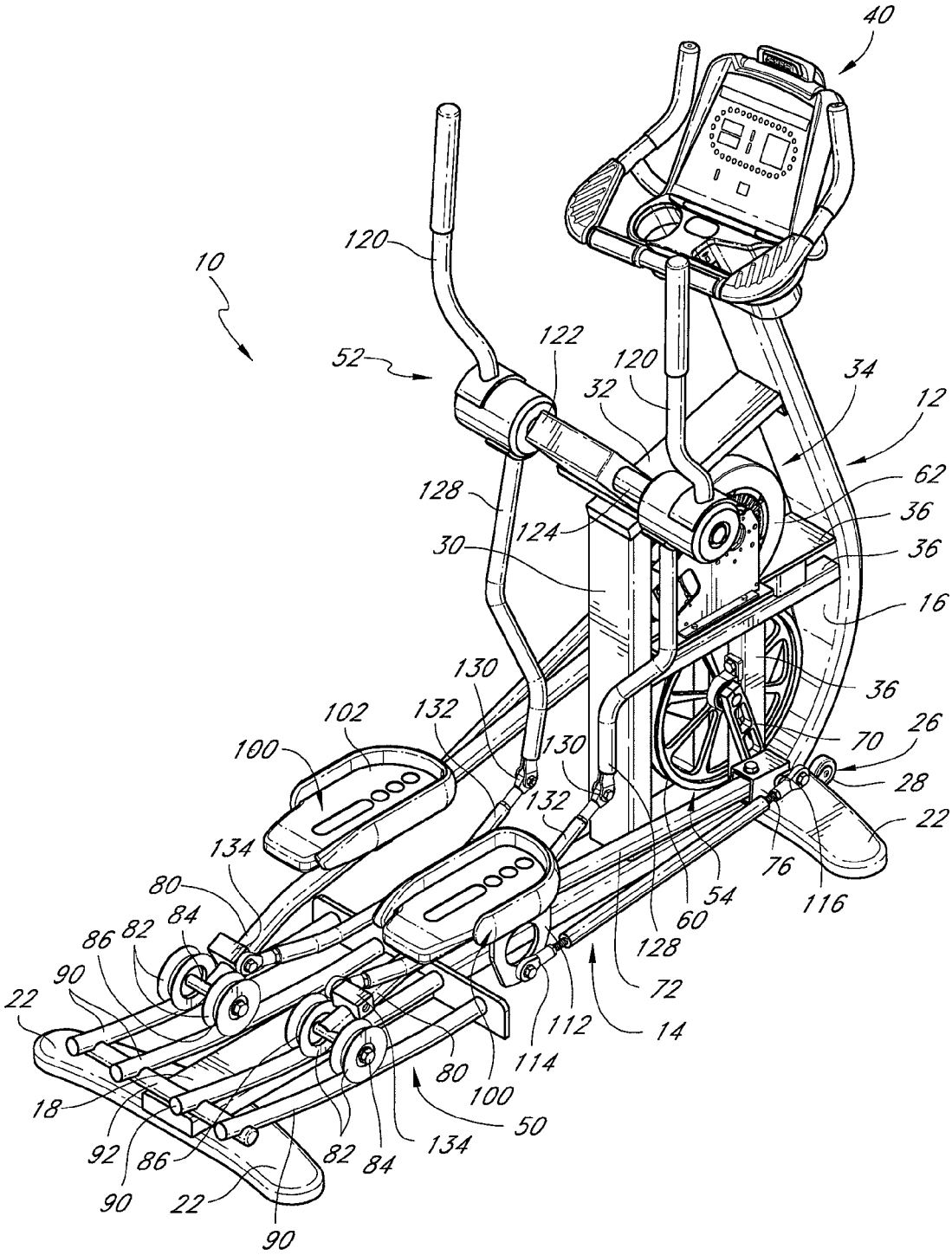
FIG. 1 is a rear, right side perspective view of an exercise machine that is arranged and configured in accordance with certain features, aspects and advantages of an embodiment of the present invention.
Figure 2:
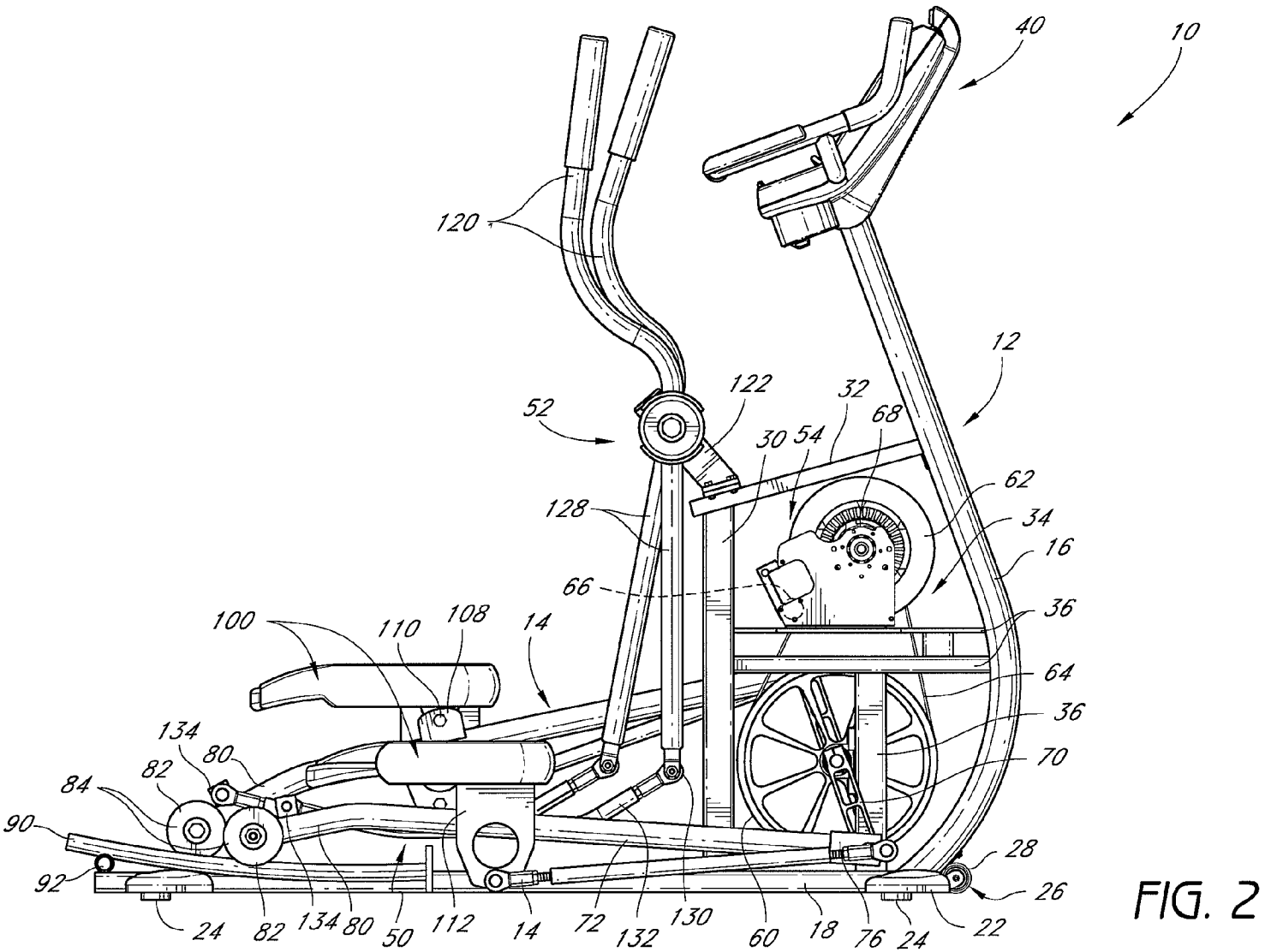
FIG. 2 is a side elevation view of the exercise machine of FIG. 1.
Figure 4:
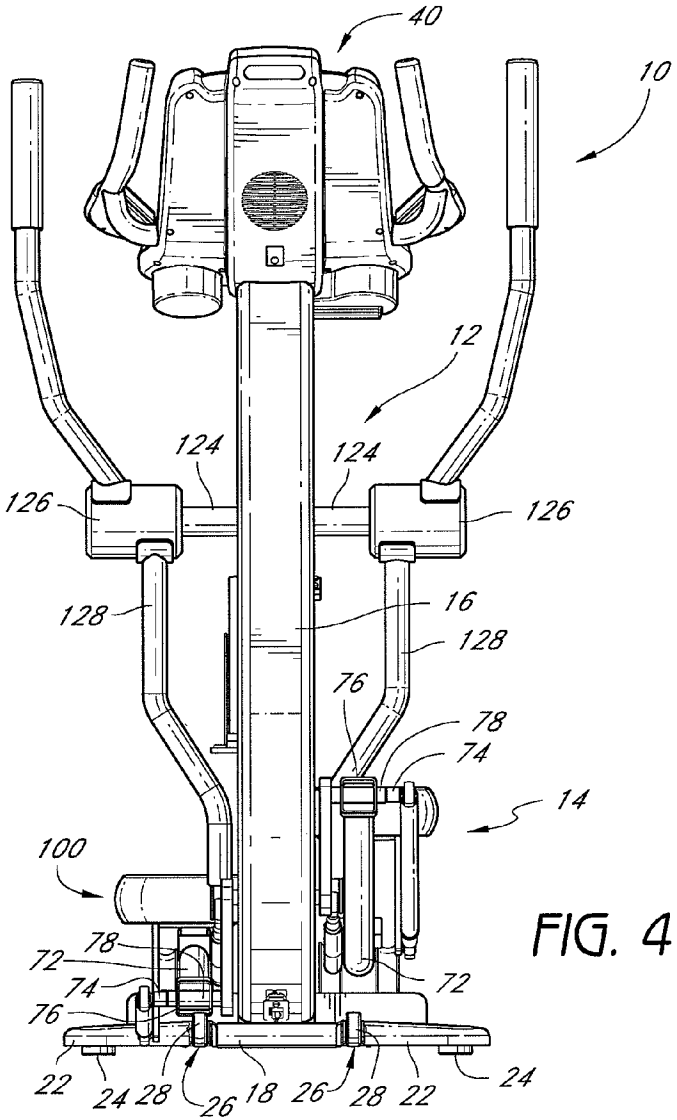
FIG. 4 is a front elevation view of the exercise machine of FIG. 1.
Figure 3:
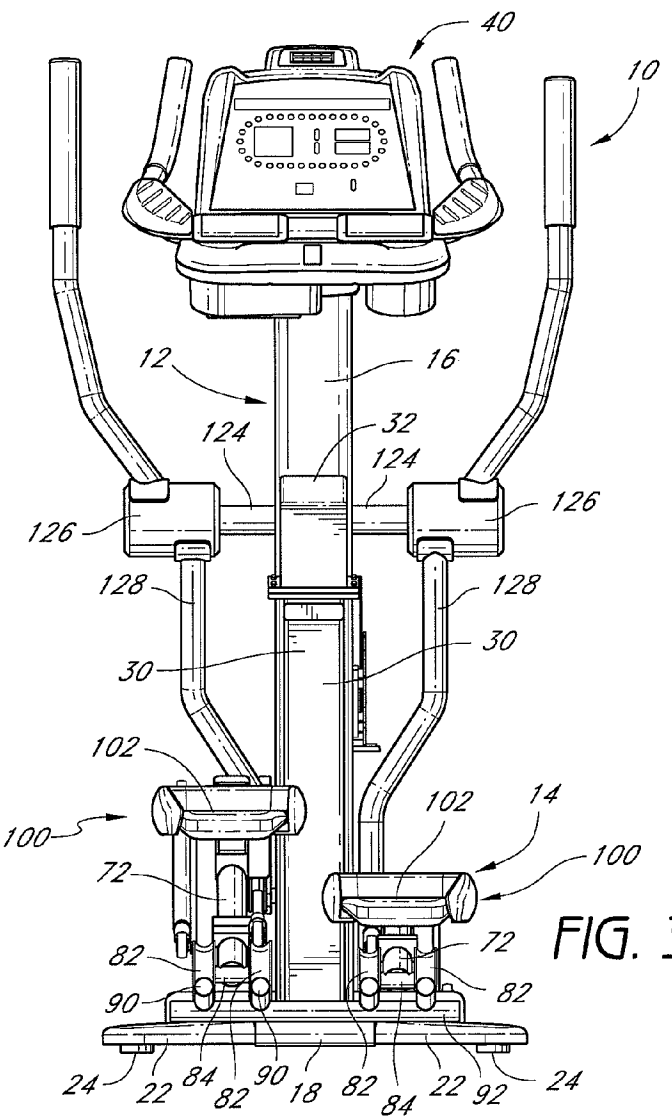
FIG. 3 is a rear elevation view of the exercise machine of FIG. 1.

An exercise machine 10 is designed and configured to drive an elliptical or elongated footpath movement for use by an exercising individual. The exercise machine 10 generally comprises a frame assembly 12 and a movement linkage assembly 14.

The frame assembly 12 can have any suitable configuration. In the illustrated arrangement, the frame assembly 12 generally comprises a forward upright member 16 and a base member 18. The forward upright member 16 can be secured to the base member 18 in any suitable manner. In one arrangement, the forward upright member 16 can be bolted to the base member 18 using a flange or the like. In other arrangements, the forward upright member 16 can be secured to the base member 18 by welding or the two members 16, 18 can be integrally formed.

Wing members 22 extend laterally outward from the base member 18. The wing members 22 provide a location to which leveling feet 24 can be mounted. The leveling feet 24 can have any suitable construction. The leveling feet 24 allow the exercise device 10 to be placed on somewhat uneven surfaces and to be leveled to provide an adequate support base for exercise. While leveling feet 24 are used in the illustrated configuration, the leveling fee 24 can be omitted in other configurations.

In the illustrated arrangement, forward rollers 26 are provided on the frame. The rollers 26 are positioned such that the wheels 28 of the rollers 26 are suspended above the ground. In this manner, the exercise machine 10 would need to be raised at the rear to place the wheels 28 in contact with the floor. With the wheels 28 of the rollers 26 in contact with the floor and the rear of the exercise machine 10 elevated, the exercise machine 10 can be relocated quickly and easily by rolling the exercise machine 10 on the wheels 28.

The illustrated exercise machine 10 also comprises a rearward upright member 30. The rearward upright member 30 preferably is significantly shorter than the forward upright member 16. In addition, the rearward upright member 30 preferably is connected to the forward upright member 16 by a brace member 32.

Collectively, the forward upright member 16, the rearward upright member 30, and the brace number 32 define a drive chamber 34. Mounting struts 36 are provided within the drive chamber 34 and are used to mount various components used in the movement linkage assembly 14. The mounting struts 36 also provide mounting locations for electronics and other control components. Other suitable mounting arrangements can be used.

At an upper end of the forward upright member 16, a display assembly 40 is connected to the frame assembly 12. The display assembly 40 can be any suitable display assembly known to those of ordinary skill in the art. For instance, in some arrangements, the display assembly 40 can provide feedback information and can also provide controls and operator inputs.

As illustrated, the movement linkage assembly 14 comprises a leg movement portion 50, an arm movement portion 52, and a generator portion 54. The generator portion 54 generally comprises a drive wheel 60 and a generator 62. In the illustrated arrangement, the drive wheel 60 is connected to the generator 62 by a belt 64. The belt 64 preferably is tensioned by an idler pulley 66. Thus, as illustrated, the drive wheel 60 rotates an input pulley 68 that is connected to the generator 62 while the idler pulley 66 applies a tension to the belt 64 to reduce the likelihood of slippage. Other suitable connection arrangements also can be used, such as, for example, but without limitation, chains, ribbed belts and pulleys, and the like. In some arrangements, a gear drive arrangement can be used in place of endless transmitters, pulleys and sprockets.

Crank arms 70 are connected to the drive wheel 60. Thus, one crank arm 70 is positioned on each side of the drive wheel 60. In the illustrated arrangement, pillow block bearings are placed on each side of the drive wheel 60. The bearings journal the drive wheel 60 for rotation about a central axis A. The crank arms 70 are positioned on each lateral side of the drive wheel 60 and preferably are positioned at about 180° out of phase relative to each other.

For ease of reference, the term "proximal" will describe the end of each crank arm 70 that is connected to the drive wheel 60, and the term "distal" will be used to refer to the end of each crank arm 70 that is positioned further away from the central axis A. Connecting links 72 are rotationally connected to the distal end of the crank arms 70. In other words, each crank arm 70 is connected to a corresponding connecting link 72.

The connecting links 72 can be secured to the crank arms in any suitable manner. In the illustrated arrangement, a stub shaft 74 extends laterally outward from the distal end of the respective crank arm 70. A mounting fixture 76 is connected to the stub shaft 74 with an outer sleeve 78 that substantially encases the stub shaft 74. In other words, the outer sleeve 78 does not rotate with the movement of the crank arms while the stub shaft 74, which is secured to the crank arm 70, rotates as the crank arm rotates. The outer sleeve 78 and the mounting fixture 76 can be joined to the connecting link 72 in any suitable manner. In one arrangement, the connecting link 72 is bolted to the mounting fixture 76 and movement of the mounting fixture 76 and the outer sleeve 78, collectively, relative to the axis about which the outer sleeve 78 is connected to the crank arm 70 is dictated by the translating movement of the connecting link 72.

For ease of reference, with respect to each connecting link 72, the term "proximal" will mean the end that is closest to the crank arm 70, and the term "distal" will mean the end that is farther away from the crank arm 70. The illustrated connecting link 72 comprises a downturned portion 80 at its distal end. The downturned portion 80 is connected to a pair of rollers 82. While a pair of rollers is used in the illustrated arrangement, other suitable configurations also are possible. In some configurations, a single roller can be used. In other configurations, more than two rollers can be used.

The rollers 82 are mounted to rotate relative to a common shaft 84. The exterior surfaces of the rollers 82 preferably have a recessed central region. The recessed central region 86 corresponds to rails 90 on which the rollers 82 translate. In some configurations, the rails can be replaced by ramps, planes or any other suitable structure.

The rails 90 are secured to the base member 18 in any suitable manner. In the illustrated arrangement, the rails 90 are formed of tubing and are spaced from one another laterally. The rails 90 are secured to mounting flanges 92 in any suitable manner. In the illustrated arrangement, the rails 90 are welded to the mounting flanges 92. The rails preferably comprise an arcuate configuration. In other words, the central portion of each of the rails preferably is depressed downward such that both ends of the rails 90 are elevated above the central portion. In the illustrated arrangement, the rear portions, or the portions further away from the crank arms 70, are elevated above the forward portions, which are the portions closer to the crank arms 70.

Foot members 100 are secured to the connecting links 72 in any suitable manner. In the illustrated arrangement, the foot members comprise an enlarged footpad 102, which is bolted through a base plate. In one configuration, four bolts are used to secure the footpad 102 to the base plate. Other suitable configurations also can be used.

The base plate preferably is pivotally connected to the connecting links 72. In the illustrated arrangement, a downward extending boss or protrusion depends from the bottom of the base plate and the boss is pivotally secured to a pair of stays 108 such as with an axle or fastener or the like. The illustrated stays 108 are secured to each lateral side of an intermediate portion of the illustrated connecting links 72. The stays 108 preferably comprise an opening through which a bolt 110 is used to secure the boss relative to the stays 108 for pivotal movement.

In the illustrated configuration, an extension member 112 depends downward from the base plate 104. The extension member 112 can have any suitable configuration and is used to space a pivotal mounting point vertically downward relative to the base plate 104.

A connecting rod 114 extends forward from the extension member 112 and the forward end of the connecting rod is joined to the stub shaft 74 by an offset link 116. The connecting rod 114 can have its length adjusted to properly account for the distance between the offset link 116 and the mounting portion of the extension member 112. Alteration of the relative rotational position or orientation of the offset link 116 and the crank arm 70 can be used to alter the movement of the foot members 100 such that the orientation of the heel and toe can be varied during the range of movement of the connecting links 72. In one advantageous configuration, the offset link 116 is positioned at about 85° relative to the crank arm 72.

As illustrated, the exercise machine 10 also comprises an arm movement portion 52. The arm movement portion 52 preferably provides movement of arm supports 120 that generally corresponds to movement of the leg movement portion 50.

The arm supports 120 in the illustrated arrangement are secured to the rearward upright member 30 by a mounting bracket 122. In the illustrated arrangement, the mounting bracket 122 is bolted to the brace member 32, but in other configurations, the mounting bracket 122 can be secured to the rearward upright member 30 directly, or can be formed of a portion of the rear upright member 30.

A pair of fixed shafts 124 extends laterally outward from the mounting bracket 122. Barrels 126 are provided about the ends of the fixed shafts 124 and are supported for rotation relative to the fixed shafts 124 by suitable bearing assemblies. The illustrated arm supports 120 are secured to the barrels 126 in any suitable manner. In the illustrated arrangement, the arm supports 120 are provided with flanges that are bolted to the barrels 126. In other configurations, the arm supports 120 can be directly welded or otherwise suitably secured to the barrels 126. In one advantageous configuration, the arm supports 120 can be provided with a lockout mechanism to secure the arm supports 120 from movement relative to the display member 40.

As illustrated, a connecting extension 128 extends downward from the barrel 126. In some configurations, the connecting extension 128 can be integrally formed with the arm supports 120. In the illustrated arrangement, the connecting extension 128 extends downward from the barrel and is coupled thereto by a flange and bolt configuration. In other configurations, the connecting extension 128 can be welded to, or otherwise suitable secured to, the barrel 126. The illustrated connecting extensions 128 advantageously comprise a bend approximately in the middle by which the lower portion of the connecting extensions 128 are laterally offset in an inward direction relative to the upper ends. In this manner, the connecting extensions 128 are not likely to interfere with the connecting links 72.

A lower portion of the connecting extension 128 carries a trunnion 130 or the like. The trunnion 130 provides a suitable connection to the connecting extension 128 of a connecting rod 132. In the illustrated arrangement, the connecting rod 132 is provided with two bends to define a wide U-shape when viewed from the side view of the machine 20, which bends provide a suitable geometry to the connecting rod 132.

In other arrangements, the connecting rod 132 can comprise a bent member or a straight member. The illustrated bent connecting rod 132 advantageously reduces the likelihood of interference between the connecting rod 132 and the foot member 100.

The forward portion of the connecting rod 132 is connected to the trunnion 130. A rearward end of the connecting rod 132 is secured to the connecting link 72 in any suitable configuration. In the illustrated arrangement, a mounting boss 134 is secured to the connection link 72 and provides a mounting location to which a rod end of the connecting rod 132 can be secured. Through the use of the connecting rod 132, the trunnion 130 and the relative placements of the barrels 126, the arm movement can be driven such that as the foot member 100 moves forward, an upper end of the arm supports 120 swings rearward.

The illustrated exercise machine 10 advantageously generates a generally elliptical movement with corresponding movement of the arm supports 120. The movement provides a user with a locked knee at approximately the initiation of the downward portion of the elliptical movement. In this manner, the user can place his or her weight upon the locked leg and generate the downward and rearward movement of the elliptical motion. At approximately its rearward most point, the user's leg will then forced to bend at the knee to generate suitable movement for generating the elliptical motion.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. An elliptical exercise machine comprising a frame assembly, a drive wheel, a first connecting link and a second connecting link connected to the drive wheel such that a first end of said first connecting link and a first end of said second connecting link rotate about an axis and said drive wheel also rotates about said axis, a second end of said first connecting link and a second end of said second connecting link moving along a support surface, a first foot pad axially secured to an intermediate portion of said first connecting link and a second foot pad axially secured to an intermediate portion of said second connecting link, said first foot pad capable of pivoting on said intermediate portion of said first connecting link and said second foot pad capable of pivoting on said intermediate portion of said second connecting link, a first connecting rod being connected at a first end to said first foot pad and at a second end to said first end of said first connecting link, a second connecting rod being connected at a first end to said second foot pad and at a second end to said first end of said second connecting link, a first mounting boss being secured to said first connecting link at a location rearward of said first foot pad, an arm linkage being connected to said first mounting boss and said arm linkage comprising a first arm connecting rod that is connected to said first mounting boss.

2. The machine of claim 1, wherein said first and second connecting links each comprise a downwardly turned second end.

3. The machine of claim 2, wherein said downwardly turned second end of said first connecting link is positioned rearward of said first foot pad.

4. The machine of claim 1, wherein said first connecting rod is connected by a first offset link to at least one of said first foot pad and said first end of said first connecting link.

5. The machine of claim 1, wherein the first arm connecting rod comprises a pair of bends such that said first connecting rod has a generally U-shaped appearance.

6. The machine of claim 1, wherein said first arm connecting rod is connected to a first connecting extension.

7. The machine of claim 6, wherein said first connecting extension comprises a trunnion that couples said first arm connecting rod to said first connecting extension.

8. The machine of claim 7, wherein said first connecting extension is connected to a barrel.

9. The machine of claim 8, wherein said barrel is pivotally secured to said frame assembly.

10. The machine of claim 9, wherein a first arm support is connected to said barrel and extends generally upward from said barrel.

11. The machine of claim 1, wherein said second end of said first connecting link is secured to a first wheel assembly.

12. The machine of claim 11, wherein said first wheel assembly comprises a pair of wheels.

13. The machine of claim 12, wherein each of said pair of wheels comprises a recessed central region.

14. The machine of claim 13, wherein said recessed central region of each of said pair of wheels generally corresponds to a rail and said rail defines said curved surface.

15. The machine of claim 14, wherein said rail has a forward end and a rearward end and said forward end and said rearward end are disposed vertically higher than an intermediate region of said rail.

* * * * *

UNITED STATES PATENT AND TRADEMARK OFFICE

CERTIFICATE OF CORRECTION

PATENT NO. : 7,666,122 B2
APPLICATION NO. : 11/458338
DATED : February 23, 2010
INVENTOR(S) : Chiles et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 579 days.

Signed and Sealed this

Twenty-eighth Day of December, 2010

David J. Kappos

David J. Kappos
*Director of the United States Patent and Trademark Office*